US005224616A

United States Patent [19]

Crisci

[11] Patent Number: 5,224,616

[45] Date of Patent: Jul. 6, 1993

[54] NON-REPLACEABLE SNAP ON CAP FOR SCHOOL MILK BOTTLES

[75] Inventor: Harry E. Crisci, New Castle, Pa.

[73] Assignee: Northern Engineering and Plastics Corp., New Castle, Pa.

[21] Appl. No.: 931,006

[22] Filed: Aug. 17, 1992

[51] Int. Cl.[5] ..... B65D 17/40; B65D 41/32

[52] U.S. Cl. ..... 215/256; 215/254; 220/270

[58] Field of Search ..... 215/256, 252, 254, 258; 220/270

[56] References Cited

U.S. PATENT DOCUMENTS

| | | | |
|---|---|---|---|
| 3,979,003 | 9/1976 | Allen | 215/256 |
| 4,230,229 | 10/1980 | Crisci . | |
| 4,341,318 | 7/1982 | Smalley | 215/256 X |
| 4,593,830 | 6/1986 | Bullock . | |
| 4,691,834 | 9/1987 | Bullock . | |
| 4,784,296 | 11/1988 | Bullock . | |
| 4,815,617 | 3/1989 | Cullum . | |
| 4,844,268 | 7/1989 | Bullock . | |
| 4,911,316 | 3/1990 | Tackles . | |
| 5,036,991 | 8/1991 | Wallman | 215/256 |
| 5,050,754 | 9/1991 | Marino | 215/256 |

*Primary Examiner*—Allan N. Shoap
*Assistant Examiner*—Paul A. Schwarz
*Attorney, Agent, or Firm*—Harpman & Harpman

[57] ABSTRACT

A snap on non-replaceable cap for a plastic bottle neck has an upper skirt and an inwardly spaced sealing flange, the inner opposed surfaces of the upper skirt and the sealing flange are curved downwardly and away from one another. A tear skirt is joined to the lowermost edge of the upper skirt to form a thin circumferential tear line. An inturned rib is formed on the inner surface of the tear skirt which locks under an external rib on the neck. The tear skirt, including the inturned rib, may be completely or partially torn off to permit the cap to be removed. To facilitate removal, the tear skirt is formed with a vertical tear line from the lower edge thereof to the circumferential tear line. A tab formed adjacent the vertical tear line functions as a lift tab.

5 Claims, 1 Drawing Sheet

NON-REPLACEABLE SNAP ON CAP FOR SCHOOL MILK BOTTLES

BACKGROUND OF THE INVENTION

1. Technical Field:

This invention relates to a new and improved snap on type plastic cap which fits on a plastic bottle neck such as a school milk bottle. The cap is characterized in that when the lower portion of the skirt thereof is torn off to permit removal of the cap, the remaining upper portion of the cap cannot be reattached to the bottle neck due to the formation of the inner surface of the upper skirt in opposed relation to the outer surface of the sealing flange spaced inwardly thereof so as to prevent the use of the cap as a reclosure cap.

2. Description of the Prior Art:

Caps generally similar to that of the present invention are the subject of many patents including the following, all of which have means permitting the use of the cap or a portion thereof as a reclosure cap. The neck shown in the accompanying drawings resemble a commercially available neck of the type shown in U.S. Pat. No. 4,784,296 which also shows single diameter cap skirts which are frangible on a circumferential tear line.

Other single diameter cap skirts which are frangible on a tear line are shown in U.S. Pat. Nos. 4,593,830, 4,691,834, and 4,815,617.

Dual diameter cap skirts which are frangible on a circumferential line between two diameters are shown in U.S. Pat. Nos. 4,232,229, 4,844,268, 4,911,316 and 4,934,546. In each of the above prior art patents, means is provided in the upper skirt for a complimentary fastening relation to an external rib on the neck of the bottle and such means is positioned below the top of the cap and above the circumferential tear line.

SUMMARY OF THE INVENTION

The present invention comprises a cap which fits on the neck of a blow molded plastic bottle and is held thereon by an annular inturned rib on the inner surface of the tear skirt below the circumferential tear line which is defined by an annular area of weakness joining the upper annular edge of the tear skirt to the lower annular edge of the upper skirt of the cap. There is a vertical tear line which extends upward from the lower edge of the tear skirt adjacent a pull tab to the upper circumferential tear line which is used to remove the tear skirt along the circumferential tear line from the upper skirt of the cap to which it is attached. The upper skirt forms the annular peripheral edge of the cap and has its inner surface formed in a downwardly and outwardly curved surface which is progressively thinner toward its lower edge which with the upper edge of the tear skirt forms the circumferential tear line by reason of its thin wall formation. The upper inner surface of the tear skirt is formed with an upwardly and outwardly curving surface joining the area of the circumferential tear line which provides reinforcement of the lower portion of the upper skirt as long as the tear skirt is attached thereto and which permits outward flexing and distortion of the upper skirt when the tear skirt is removed completely or partially.

The annular sealing flange on the cap inwardly of the upper skirt is provided with a downturned and inturned curving surface with the area between the upper portions of the sealing flange and the upper skirt forming an annular cavity into which the upper end of the neck of a bottle having an external rib thereon is positioned when the non-replaceable snap on cap is positioned on a bottle neck. The resilient flexible oppositely curved areas of the upper portion of the snap on cap will not stay engaged on the upper end of the neck portion of a bottle when the tear skirt of the cap is removed.

DESCRIPTION OF THE PREFERRED EMBODIMENT

Figure 4:
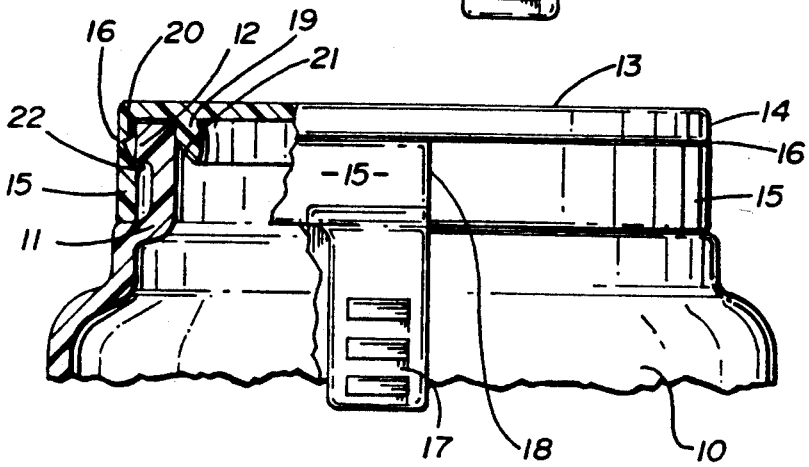
FIG. 4 is a side elevation of the cap and a portion of a bottle neck with parts broken away and parts in cross section showing the position of the elements of the cap on the neck of the bottle.

In FIG. 4 of the drawings, a bottle 10 has a neck portion 11 with an outturned rib 12 defining its upper end. A cap is positioned on the neck portion 11 and comprises a top 13 having an upper skirt 14 forming a peripheral edge thereof and a tear skirt 15 secured integrally to said upper skirt 14 by a circumferential thin wall forming a tear line 16. A tab 17 is integrally formed with the tear skirt 15 of the cap and a vertically extending thin wall forms a secondary tear line 18 between the lower edge of the tear skirt 15 and the tear line 16 and is located adjacent the tab 17.

Still referring to FIG. 4 of the drawings, it will be seen that the upper end of the neck 11 with its outturned rib 12 has been moved into position between the inner surface 20 of the upper skirt 14 and the outer surface 21 of an annular sealing flange 19, the space being smaller than the width of the upper end of the neck 11 and its outturned rib 12 so that distortion of the annular sealing flange 19 occurs.

Figure 1:
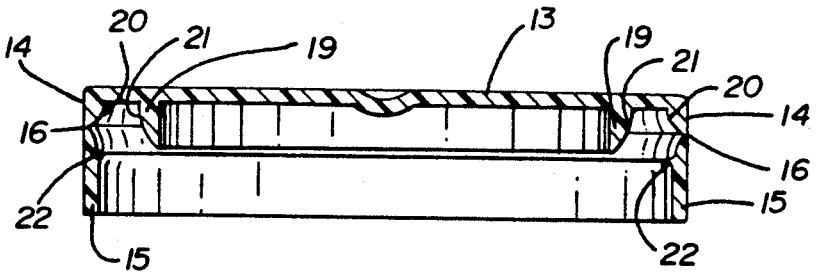
FIG. 1 is a vertical sectional view through a cap in accordance with the present invention.

By referring now to FIG. 1 of the drawings, a vertical sectional view of the new and improved snap on non-replaceable cap of the invention may be seen and it will be observed that the inner surface 20 of the upper skirt 14 is curved downwardly and outwardly from the top 13 of the cap to the thin wall which defines the tear line 16 that extends circumferentially around the cap completely or partially.

It will also be seen that the outer surface 21 of the annular sealing flange 19 is curved downwardly and inwardly from the top 13 so as to form a space between the oppositely disposed curving surfaces 20 and 21 that is smaller than the known width of the upper end of the neck 15 and its outturned rib 12 as heretofore described in connection with FIG. 4 of the drawings.

Still referring to FIG. 1, it will be seen that the tear skirt 15 has an inturned annular rib 22 positioned below an upwardly and outwardly curved annular surface 23 which joins the circumferential thin wall forming the tear line 16.

Figure 2:
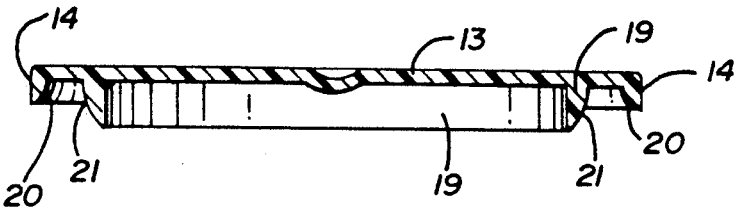
FIG. 2 is a vertical sectional view through the upper portion of the cap with the tear skirt removed.

In FIG. 2 of the drawings, the upper portion of the cap of the invention is illustrated and comprises the top 13 with its peripheral edge defining the upper skirt 14 with its downwardly and outwardly curving surface 20 spaced with respect to the distortable annular sealing flange with its outer downwardly and inwardly curving surface 21 and it will be seen that when only the upper portion of the cap as illustrated in FIG. 2 of the drawings is pushed downwardly onto the upper end of the neck portion 11 with its outturned rib 12 on the bottle 10, its elasticity and resulting distortion will cause it to move upwardly partially away from the upper end of the neck portion 11 and its outturned rib 12 and therefore be incapable of being replaced thereon. The portion of the cap remaining after the tear skirt 15 thereof is removed, is therefore not capable of being used as a reclosure cap.

The present use of the invention makes this feature highly desirable as the cap is used as a non-replaceable snap on cap for school milk bottles which as known provide a small quantity of milk or other beverage, such as chocolate milk, orange juice, tomato juice and the like.

Figure 3:
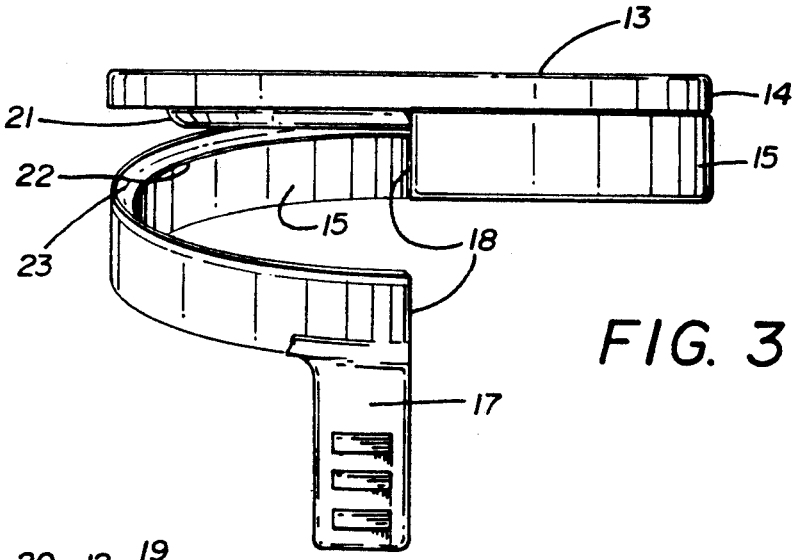
FIG. 3 is a side elevation of the cap with the tear skirt thereof partially removed from the upper portion.

By referring now to FIG. 3 of the drawings, a front elevational view of the cap may be seen including the top 10, the upper skirt 14, the tear skirt 15 and the annular sealing flange 19 with its downwardly and inwardly curved surface 21 and wherein a portion of the tear skirt 15 has been removed by pulling the tab 17 away from the remainder so as to cause separation at the vertical thin wall defining the secondary tear line 18 and continuing around the thin wall defining the tear line 16. The inturned annular rib 22 may also be seen in its position below the downwardly and outwardly curved inner surface 20 of the upper skirt 14.

It will thus be seen that a non-replaceable snap on cap for plastic bottles and the like has been disclosed which incorporates a novel construction serving the dual purpose of assisting in retaining the cap in position on the neck of a bottle of known configuration by reason of the ability of the upper skirt 14 and the annular sealing flange 19 to require distortion when in position on the neck portion of a bottle and to resist attempts to replace the upper portion of the cap on the neck portion of a bottle when the upper portion is separated from the tear skirt thereof.

I claim:

1. A snap on non-replaceable resilient deformable cap for use on a container having a neck finish with a neck rib thereon, the cap comprising: a top, an annular upper skirt depending from said top and an annular sealing flange depending from said top and located inwardly of said annular upper skirt, said upper skirt and said sealing flange each having a curved surface thereon, said curved surfaces being disposed oppositely to each other and each intersecting said top, said curved surfaces curving downwardly from said top and away from one another and being adapted to exert a force on the neck rib biasing the neck rib away from said top, a tear skirt having inner and outer surfaces depending from said upper skirt and joined to said upper skirt to form a thin wall circumferential tear line, a fastening configuration on the inner surface of said tear skirt, said fastening configuration being adapted to hold the neck rib between said curved surfaces against the force exerted on the neck rib by said sealing flange and said upper tear skirt biasing the neck rib away from said top, a thin wall vertical tear line in said tear skirt extending downwardly from said circumferential tear line and a tab formed on said tear skirt adjacent to said vertical tear line to facilitate removal of said tear skirt.

2. The snap on non-replaceable resilient deformable cap of claim 1 wherein said curved surface of said upper skirt curves downwardly and outwardly and the curved surface of said sealing flange curves downwardly and inwardly.

3. The snap on non-replaceable resilient deformable cap of claim 1 wherein said annular fastening configuration on the inner surface of said tear skirt comprises an inturned rib.

4. The snap on non-replaceable resilient deformable cap of claim 1 and wherein the oppositely disposed curved surfaces of the upper skirt and the sealing flange are progressively thinner downwardly from said top to permit outward flexing and distortion of the upper skirt and inward flexing and distortion of said sealing flange when said tear skirt is removed.

5. In combination, a snap on non-replaceable resilient deformable cap and a container:

the container including: a neck finish with a neck rib thereon, the neck rib having a width dimension measured between an inner surface of the neck finish adjacent to the neck rib and an outer surface of the neck finish adjacent to the neck rib, the neck rib having a bottom edge; and the cap including: a top, an annular upper skirt depending from said top and an annular sealing flange depending from said top inwardly of said annular upper skirt, said upper skirt and said sealing flange having oppositely disposed surfaces curved downwardly from said top and away from one another, the neck rib bottom edge being spaced from said top a predetermined distance when the cap is secured to the container, each of said curved surfaces intersecting said top, the intersections of said curved surfaces being spaced apart by a gap having a width dimension measured along said top between said intersections which is smaller than the width dimension of the neck rib to exert a force on said neck rib biasing said neck rib away from said top when said neck rib is located in said gap with the cap secured to the container, a tear skirt having inner and outer surfaces depending from said upper skirt and joined to said upper skirt to form a thin wall circumferential tear line, an annular fastening configuration on the inner surface of said tear skirt, said fastening configuration being spaced from said top by a pre-set distance which is slightly greater than said predetermined distance to engage the neck rib bottom edge when the cap is secured to the container to hold the neck rib in said gap against the force exerted on the neck rib by said sealing flange and said upper tear skirt biasing said neck rib away from said top when the cap is in place on the container with the neck rib located in said gap, a thin wall vertical tear line in said tear skirt extending downwardly from said circumferential tear line and a tab formed on said tear skirt adjacent to said vertical tear line to facilitate removal of said tear skirt.

* * * * *